United States Patent [19]

Metz et al.

[11] Patent Number: 4,461,828

[45] Date of Patent: Jul. 24, 1984

[54] SPECTRAL SENSITIZATION OF PHOTOTHERMOGRAPHIC ELEMENTS

[75] Inventors: Kenneth W. Metz, North St. Paul; Vincent K. Rasbury, Cottage Grove; Jack E. Reece, Forest Lake Township, Washington County, all of Minn.

[73] Assignee: Minnesota Mining and Manufacturing Company, St. Paul, Minn.

[21] Appl. No.: 494,264

[22] Filed: May 13, 1983

[51] Int. Cl.[3] ..... G03C 1/02

[52] U.S. Cl. ..... 430/592; 430/617; 430/618; 430/619; 430/620

[58] Field of Search ..... 430/592, 619, 617, 618, 430/620

[56] References Cited

U.S. PATENT DOCUMENTS

| | | | |
|---|---|---|---|
| 2,493,748 | 1/1950 | Brooker et al. | 542/436 |
| 3,719,495 | 3/1973 | Lea | 96/114.1 |
| 3,933,507 | 1/1976 | Konig et al. | 430/620 |
| 4,028,129 | 6/1977 | Suzuki et al. | 430/619 |
| 4,156,611 | 5/1979 | Ikenoue et al. | 430/619 |
| 4,197,131 | 4/1980 | Lea et al. | 430/617 |
| 4,283,487 | 8/1981 | Lea et al. | 430/522 |

*Primary Examiner*—Won H. Louie, Jr.

*Attorney, Agent, or Firm*—D. M. Sell; J. A. Smith; M. A. Litman

[57] ABSTRACT

A narrow range of dinuclear spectral sensitizing dyes can be used in photothermographic silver halide emulsions without adversely affecting fog and speed levels with concentration variations.

20 Claims, No Drawings

SPECTRAL SENSITIZATION OF PHOTOTHERMOGRAPHIC ELEMENTS

TECHNICAL FIELD

The present invention relates to silver halide photothermographic emulsions and in particular to the spectral sensitization of photothermographic emulsions.

BACKGROUND OF THE ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image.

As with conventional photographic silver halide, photothermographic emulsions are naturally sensitive only to the blue, violet and ultraviolet portions of the electromagnetic spectrum. The natural sensitivity is also relatively weak at those wavelengths. Dyes which have been used to spectrally sensitize photographic emulsions have been used with reasonable success to spectrally sensitize photothermographic emulsions. This is accomplished by adding the dyes to the emulsion before, during, or after formation or addition of the silver halide component.

The dyes used for spectral sensitization of photographic silver halide emulsions have found only moderate utility in photothermographic emulsions, particularly those used to sensitize in the red. This reduced utility is not with respect to potential sensitizing efficiency, but rather is with respect to the critical effects of concentration variations of the dyes. What would ordinarily be considered as insignificant variations in dye concentrations, ±15% from optimum concentrations, can have dramatic and adverse effects on the sensitometry of the photothermogrpahic emulsion. Minor variations in concentrations which can result from insufficient mixing, variations in supply rates, evaporation and other variables can cause fog, thermal instability or shelf life instability.

It would be desirable to find sensitizing dyes, particularly for the red portion of the electromagnetic spectrum, which would not be so concentration sensitive and would allow more manufacturing latitude.

SUMMARY OF THE INVENTION

It has been found in the practice of the present invention that the addition of a narrow class of merocyanine dyes to silver halide photothermographic emulsions spectrally sensitizes the emulsion to the red region of the electromagnetic spectrum without the dye causing the emulsion to be highly concentration sensitive. The dyes having a common nucleus of the structure:

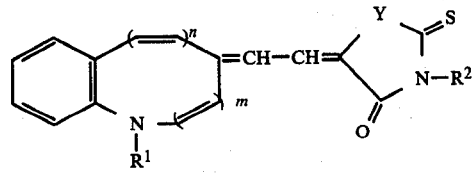

wherein m plus n equal 1,

Y is S or

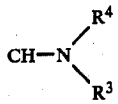

$R^1$ is an alkyl group and $R^2$, $R^3$ and $R^4$ are indepently alkyl groups, aryl group, H and $R^2$ may also be cyclohexyl, and at least one of $R^1$ and $R^2$ has an acid substituent on an alkyl group, are described as useful according to the practice of the present invention.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

In describing materials useful according to the present invention, the use of the term 'group' to characterize a class, such as alkyl group, indicates that substitution of the species of that class is anticipated and included within that description. For example, alkyl group includes hydroxy, halogen, ether, nitro, aryl and carboxy substitution while alkyl or alkyl radical includes only unsubstituted alkyl.

The dyes according to the present invention are those having a common nucleus of the structure

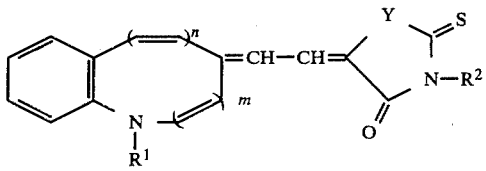

wherein Y, m, n $R^1$ and $R^2$ are as defined above.

The dyes may have any substituents on the fused benzene ring that are normally considered useful on either cyanine or merocyanine dyes without affecting the practice of the present invention. For example, alkyl, alkoxy, halogen, cyano, alkylcarboxylate, alkylsulfonate, nitro, phenyl, amino, alkaryl, aralkyl and other groups may be present on the benzene ring in any of the various available positions.

Preferably $R^1$ is alkyl of 1 to 4 carbon atoms, more preferably 2 to 4 carbon atoms, $R^2$ is alkyl of 1 to 6 carbon atoms, acid-substituted alkyl of 1 to 12 carbon atoms (on the metal or ammonium salt thereof), cyclohexyl group or phenyl group, and Y is S or

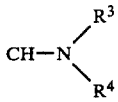

wherein $R^3$ and $R^4$ are independently alkyl of 1 to 4 carbon atoms, hydrogen, acid-substituted alkyl of 1 to 6 carbon atoms. Also preferably, n=0 and m=1. The term "acid-substituted alkyl" means an alkyl group having an acid substituent attached thereto, the acid substituent being to the form of the acid or the metal salt or ammonia salt thereof. Preferred acid substituents are —COOH and $SO_3H$, with carboxylate more preferred. Metal or ammonium salts of these acid groups are also desirable. It is also preferred to use acid-substituted alkyl groups of 1 to 8 carbon atoms (e.g., $(CH_2)_nCOOH$ wherein n is 1 to 8) and more preferred to use acid-substituted groups of 1 to 6 carbon atoms. It is also preferred that the fused benzene ring remain unsubstituted.

The methods of making merocyanine dyes are generally well known in the literature such as *Cyanine Dyes and Related Compounds*, E. F. Hamer, Interscience Publ., 1964, U.S. Pat. No. 2,493,748, and U.K. Pat. Nos. 428,222, 428,359 and 519,895.

These and other aspects of the present invention will be shown in the following non-limiting examples.

EXAMPLE 1

Synthesis of dyes according to the present invention may be made as generally known in the art and as shown below.

1-ethyl-4-methyl-quinolinium iodide (0.5 mole 149.5 g), diphenyl formamidine (0.55 mol 108 g) and acetic anhydride (500 ml) were mixed and heated at reflux for 20 minutes. The cooled solution was poured into diethyl ether (1½) to precipitate the 4-acetanilino derivative. After standing, the supernatent liquid was decanted off and discarded. The residue was dissolved by warming in a mixture of ethanol (1100 ml) and water (55 ml), and to this solution was added 3-carboxymethyl-4-oxo-2-thioxothiazolidine (0.45 ml, 86.4 g). The whole mixture was heated and triethylamine (1 mol, 140 ml) run in. Heating under reflux was maintained for 15 minutes and the resulting dye solution filtered hot. After the addition of a further 500 mls of 95% aqueous ethanol the solution was made acid by the addition of 500 mls of aqueous 2 N hydrochloric acid.

The dye separated from solution and was filtered off while still warm and then washed with more aqueous ethanol. The damp, crude dye was then twice extracted with boiling 95% aqueous methanol (2 portions) and finally the dye residue was dried in vaccuo at 55° C. to leave 80 g of dye. Other dyes were similarly prepared.

The 3(5-carboxy-n-pentyl) analogue of 3-carboxymethyl-4-oxo-2-thioxothiazolidine was prepared exactly according to the procedures of example 26 of U.S. Pat. No. 2,493,748 substituting a molar equivalent of 6-aminohexanoic acid for glycine. 3(5-carboxy-n-pentyl)-4-oxo-2-thioxothiazolidine was obtained as an off-white somewhat waxy solid with m.p. 70.5° C.

EXAMPLES 2-4

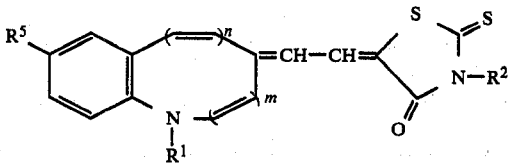

In these examples, the compound were as follows:

| Ex. | $R^5$ | n | m | $R^2$ | λ*max | $*\epsilon \times 10^{-4}$ |
|---|---|---|---|---|---|---|
| 2 | H | 0 | 1 | $CH_2COOH$ | 615(575) | 11.2 |
| 3 | $C_2H_5O$ | 1 | 0 | $CH_2COOH$ | 574(544) | 10.3 |
| 4 | H | 0 | 1 | $(CH_2)_5COOH$ | 616(576) | 12.4 |

Each of these dyes were added to a typical in situ halidized photothermographic emulsion in amounts of 0.1-0.2 molar percent of silver halide and found to effectively sensitize the emulsion.

EXAMPLES 5-16

To 700 g. of a dispersion containing 12.5 parts of silver behenate, 6.5 parts of methyl isobutyl ketone, 21 parts of toluene, and 60 parts of methyl ethyl ketone maintained at 15° C. with stirring was added the following sequence of materials at 15-minute intervals: 7 g of Butvar B-76$^R$ (poly(vinyl butyral) resins, Monsanto), 7 g. of 1-methyl-1-pyrrolidone, 4 g. of 0.5 molal mercuric bromide in ethanol, 20 g. of 2 molal hydrobromic acid in ethanol, 70 g. of Butvar B-76$^R$, 14 g. of an antioxidant, and 7.6 g. of phthalazinone. After 15 minutes' stirring and digesting following the last addition, the emulsion was ready for dye sensitization.

To separate 50 g. aliquots of the emulsion was added 3.2 and 4.2 micromoles of each of the dyes 1, 11a, $R^1=C_2H_5$; n=1, m=0, Y=S, $R^2=CH_2CO_2H$) and 11b (same as 11a except n=0, m=1, $R^2=(CH_2)_5CO_2H$) (compounds 2 and 3, respectively). After 20 minutes' digestion these aliquots were ready for coating. A convenient method for handling the dyes was as 0.3% to 1.0% solutions in 1-methyl-2-pyrrolidinone.

Using a knife coater with the orifice set 100 microns over a polyester web, two coatings were made from each aliquot and dried each for 4 minutes at 90° C. in a forced draft oven.

Next was applied a protective overcoat using the knife coater with the orifice set at 75 microns over the first trip and the coating dried as above. The overcoat solution contained 5 parts of a polyvinyl acetate-polyvinyl chloride copolymer (Union Carbide VYNS®) and 95 parts methyl ethyl ketone.

Processing of several strips from each film sample was done at both 20 seconds and 60 seconds using either an inert fluid dip tank processor or heat surface processor maintained at 127° C. The superiority of these new dyes in this formulation is seen in comparing the $D_{min}$ values obtained. Table 1 summarizes these findings.

TABLE 1

| Film Samples | Dye | μmoles/ 50 g. emulsion | $D_{min}$ Values 20 vis | Secs W36 | 60 vis | (replicate average) Secs W36 | vis | (60-20) 1036 |
|---|---|---|---|---|---|---|---|---|
| 1,2 | 1 | 3.2 | .11 | .17 | .20 | .28 | .09 | .11 |
| 3,4 | 1 | 4.2 | .11 | .18 | .27 | .36 | .16 | .18 |
| 5,6 | 11a | 3.2 | .10 | .17 | .16 | .24 | .07 | .08 |
| 7,8 | 11a | 4.2 | .11 | .18 | .18 | .27 | .07 | .09 |
| 9,10 | 11b | 3.2 | .10 | .17 | .13 | .21 | .03 | .04 |
| 11,12 | 11b | 4.2 | .10 | .16 | .14 | .23 | .04 | .07 |

The improved response of the emulsions containing the new dyes to the Wratten 36 filter, a measure of "duping $D_{min}$" encountered when one uses diazo or vesicular materials to make duplicates of original films, was particularly desirable. Of additional importance was the minimal effect on $D_{min}$ due to a 30% overcharge of the new dyes of 60 second $D_{min}$ compared to the standard dye. This is analogous to the effect seen when one overworks solutions during coating operations.

Dye 1 is a trinuclear merocyanine dye presently used in some commercial embodiments of photothermographic emulsions and has the formula:

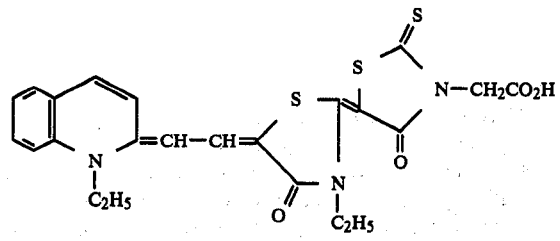

As previously noted, various other adjuvants may be added to the photothermographic emulsions of the present invention. For example, toners, accelerators, acutance dyes, sensitizers, stabilizers, surfactants, lubricants, coating aids, antifoggants, leuco dyes, chelating agents, and various other well known additives may be usefully incorporated.

A preferred silver halide emulsion was formed according to Example 1 of U.S. Pat. No. 4,161,408 using 7 mole percent silver bromochloride to 93 mole percent of silver behenate. The dyes were added to the emulsion immediately before coating. The samples were then oven dried at 90° F. Dye 1 of Examples 5-16 was again used for comparison. The dyes of the invention used were 11a, 11b, 11c (dye 11a with $R^5=C_2H_5$). The data are recorded below, with the concentration of the dye given as micromoles of dye per 50 grams of emulsion.

TABLE 2

| Dye | Conc. | Dmin | Relative Speed 600 nm | 620 nm | 640 nm |
|---|---|---|---|---|---|
| 1 | 3 | 0.14 | 145 | 100 | 76 |
| 1 | 3.6 | 0.21 | 137 | 106 | 114 |
| 11a | 6.0 | 0.16 | 279 | 197 | 87 |
| 11a | 7.2 | 0.17 | | | |
| 11b | 4.8 | 0.17 | 335 | 305 | 172 |
| 11b | 9.6 | 0.19 | | | |
| 11c | 7.2 | 0.20 | 134 | 186 | 100 |

No readings for speed were taken at the higher dye concentrations for 11a and 11b. The dye concentrations used show that even as much as a two-fold increase in dye concentration according to the present invention can have less effect than a 20% variation in dyes previously used to sensitive photothermographic emulsions.

We claim:

1. A photothermographic emulsion comprising a binder, a non-light sensitive silver source material, photographic silver halide in catalytic proximity to said silver source material and a reducing agent for silver ion characterized by the presence of a spectrally sensitizing amount of a dye having either of the nuclei:

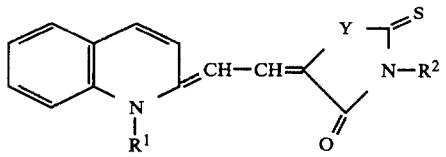

and

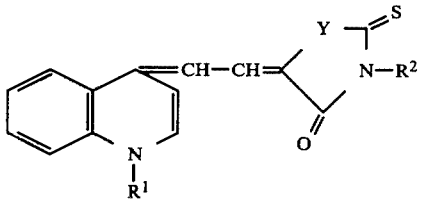

wherein $R^1$ is selected from the group consisting of alkyl groups of 1 to 4 carbon atoms, $R^2$ is selected from the group consisting of hydrogen, alkyl groups, aryl groups and cyclohexene, Y is selected from the group consisting of S and

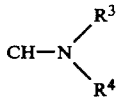

wherein $R^3$ and $R^4$ are independently selected from the group consisting of H, alkyl groups, and aryl group, with the proviso that at least one of $R^2$, $R^3$ and $R^4$ is an acid substituted alkyl.

2. The emulsion of claim 1 wherein $R^1$ is alkyl of 2 to 4 carbon atoms.

3. The emulsion of claim 1 wherein Y is S.

4. The emulsion of claim 2 wherein Y is S.

5. The emulsion of claim 1 wherein $R^2$ is acid-substituted alkyl.

6. The emulsion of claim 1 wherein $R^2$ has the structure $(CH_2)_nCOOH$ wherein n is 1 to 12.

7. The emulsion of claim 2 wherein $R^2$ has the structure $(CH_2)_nCOOH$ wherein n is 1 to 12.

8. The emulsion of claim 3 wherein $R^2$ has the structure $(CH_2)_nCOOH$ wherein n is 1 to 12.

9. The emulsion of claim 1 wherein the fused benzene ring has substituents selected from the class consisting of alkyl groups, alkoxy groups, nitro, halogen, phenyl, alkaryl, aralkyl, alkylcarboxylate, amino and alkylsulfonate.

10. The emulsion of claim 3 wherein the fused benzene ring has substituents selected from the class consisting of alkyl groups, alkoxy groups, nitro, halogen, phenyl, alkaryl, aralkyl, alkylcarboxylate, amino and alkylsulfonate.

11. The emulsion of claim 5 wherein the fused benzene ring has substituents selected from the class consisting of alkyl groups, alkoxy groups, nitro, halogen, phenyl, alkaryl, aralkyl, alkylcarboxylate, amino and alkylsulfonate.

12. The emulsion of claim 8 wherein the fused benzene ring has substituents selected from the class consisting of alkyl groups, alkoxy groups, nitro, halogen, phenyl, alkaryl, aralkyl, alkylcarboxylate, amino and alkylsulfonate.

13. A photothermographic recording article comprising the emulsion of claim 1 coated on a substrate.

14. A photothermographic recording article comprising the emulsion of claim 3 coated on a substrate.

15. A photothermographic recording article comprising the emulsion of claim 5 coated on a substrate.

16. A photothermographic recording article comprising the emulsion of claim 8 coated on a substrate.

17. A photothermographic recording article comprising the emulsion of claim 10 coated on a substrate.

18. A photothermographic recording article comprising the emulsion of claim 12 coated on a substrate.

19. The emulsion of claim 1 wherein $R^1$ is $C_2H_5$, $R^2$ is $(CH_2)_nCOOH$, n is 1 to 6, Y is S and the fused benzene ring is unsubstituted.

20. A photothermographic recording article comprising the emulsion of claim 19 coated on a substrate.

* * * * *

UNITED STATES PATENT AND TRADEMARK OFFICE

CERTIFICATE OF CORRECTION

PATENT NO. : 4,461,828

DATED : July 24, 1984

INVENTOR(S) : Kenneth W. Metz, Vincent K. Rasbury and Jack E. Reece

It is certified that error appears in the above-identified patent and that said Letters Patent is hereby corrected as shown below:

Col. 5, line 29 after "emulsion." the following sentence should be added --(*Readings taken in 95% aqueous methanol solutions with a trace of triethyl amine. The numbers in parentheses indicate secondary maxima).--

Signed and Sealed this

*Twenty-fifth* Day of *June 1985*

[SEAL]

*Attest:*

DONALD J. QUIGG

*Attesting Officer* *Acting Commissioner of Patents and Trademarks*